US011572603B2

(12) United States Patent
Hemmilä et al.

(10) Patent No.: US 11,572,603 B2
(45) Date of Patent: Feb. 7, 2023

(54) HOT-ROLLED STEEL STRIP AND MANUFACTURING METHOD

(71) Applicant: SSAB TECHNOLOGY AB, Stockholm (SE)

(72) Inventors: Mikko Hemmilä, Vihanti (FI); Tommi Liimatainen, Raahe (FI); Ari Hirvi, Kempele (FI)

(73) Assignee: SSAB TECHNOLOGY AB, Stockholm (SE)

( * ) Notice: Subject to any disclaimer, the term of this patent is extended or adjusted under 35 U.S.C. 154(b) by 0 days.

(21) Appl. No.: 17/289,865

(22) PCT Filed: Nov. 13, 2019

(86) PCT No.: PCT/EP2019/081149
§ 371 (c)(1),
(2) Date: Apr. 29, 2021

(87) PCT Pub. No.: WO2020/099473
PCT Pub. Date: May 22, 2020

(65) Prior Publication Data

US 2022/0002836 A1 Jan. 6, 2022

(30) Foreign Application Priority Data

Nov. 14, 2018 (EP) ..... 18206179

(51) Int. Cl.
*C21D 9/52* (2006.01)
*C21D 6/00* (2006.01)
(Continued)

(52) U.S. Cl.
CPC ..... *C21D 9/52* (2013.01); *C21D 1/25* (2013.01); *C21D 6/004* (2013.01); *C21D 6/005* (2013.01);
(Continued)

(58) Field of Classification Search
CPC ..... C21D 9/52; C21D 6/005; C21D 8/0226; C21D 8/0263; C21D 2211/002;
(Continued)

(56) References Cited

U.S. PATENT DOCUMENTS 1,087,090 A1 9/2018 Rijkenberg et al.
10,196,726 B2 2/2019 Azuma et al.
(Continued)

FOREIGN PATENT DOCUMENTS

CN 102439179 A 5/2012
CN 104968822 A 10/2015
(Continued)

OTHER PUBLICATIONS

International Search Report and Written Opinion dated Nov. 29, 2019 by the International Searching Authority for International Application No. PCT/EP2019/081149, filed on Nov. 13, 2019 and published as WO 2020/099473 dated May 22, 2020 (Applicant—SSAB Technology AB) (9 Pages).

*Primary Examiner* — Humera N. Sheikh
*Assistant Examiner* — Katherine A Christy
(74) *Attorney, Agent, or Firm* — Ballard Spahr LLP

(57) ABSTRACT

Disclosed is a hot-rolled steel strip having a tensile strength greater than 875 MPa and containing in mass-%:
C 0.06-0.12,
Si 0-0.5,
Mn 0.70-2.20,
Nb 0.005-0.100,
Ti 0.01-0.10,
V 0.11-0.40,
whereby the total amount of V+Nb+Ti is 0.20-0.40
Al 0.005-0.150,
B 0-0.0008,
(Continued)

Cr 0-1.0,
whereby the total amount of Mn+Cr is 0.9-2.5,
Mo 0-0.5,
Cu 0-0.5,
Ni 0-1.0,
P 0-0.05,
S 0-0.01,
Zr 0-0.1
Co 0-0.1
W 0-0.1
Ca 0-0.005,
N 0-0.01,
balance Fe and unavoidable impurities, and having a microstructure at ¼ thickness that is:
at least 90% martensite and bainite with island-shaped martensite-austenite (MA) constituents,
the remainder being:
less than 5% polygonal ferrite and quasi-polygonal ferrite,
less than 5% pearlite,
less than 5% austenite,
so that the total area percentage is 100%.

14 Claims, 6 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 1/25*** | (2006.01) |

(52) U.S. Cl.
CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/008* (2013.01)

(58) Field of Classification Search
CPC ..... C21D 2211/008; C22C 38/001; C22C 38/002; C22C 38/02; C22C 38/04; C22C 38/06; C22C 38/42; C22C 38/44; C22C 38/46; C22C 38/48; C22C 38/50; C22C 38/54
USPC ..... 428/544
See application file for complete search history.

(56) References Cited

U.S. PATENT DOCUMENTS

| | | | | |
|---|---|---|---|---|
| 10,260,124 | B2 | 4/2019 | Sakakibara et al. | |
| 11,111,553 | B2 | 9/2021 | Kimata et al. | |
| 2013/0000791 | A1* | 1/2013 | Takahashi | C22C 38/06 148/507 |
| 2015/0376730 | A1 | 12/2015 | Shuto | |
| 2016/0076124 | A1 | 3/2016 | Yamakazi et al. | |
| 2018/0265939 | A1 | 9/2018 | Rijkenberg | |

FOREIGN PATENT DOCUMENTS

| | | | |
|---|---|---|---|
| CN | 105102662 | A | 11/2015 |
| CN | 105209650 | A | 12/2015 |
| CN | 108350542 | A | 7/2018 |
| CN | 108603271 | A | 9/2018 |
| EP | 2647730 | | 10/2013 |
| JP | 2015 160985 | A | 9/2015 |
| WO | WO 2010/130871 | A1 | 11/2010 |

* cited by examiner

HOT-ROLLED STEEL STRIP AND MANUFACTURING METHOD

CROSS-REFERENCE TO RELATED APPLICATIONS

This application is a U.S. National Phase Application of International Application No. PCT/EP2019/081149, filed Nov. 13, 2019, which claims priority to European Application No. 18206179.6, filed Nov. 14, 2018, each of which are hereby incorporated by reference in their entirety.

TECHNICAL FIELD

The present invention concerns a hot-rolled steel strip having a tensile strength greater than 875 MPa, preferably greater than 900 MPa, with reasonable abrasive wear resistance and very good bendability, and a method of manufacturing such a hot-rolled steel strip.

BACKGROUND OF THE INVENTION

The current trend in many industrial areas is to create lighter designs. For example, in the automotive industry this trend is visible in the increasing usage of advanced high strength steel grades, like dual or complex phase steels. However, there are still several applications in which traditional micro-alloyed high strength steel is a more suitable material than dual or complex phase steel. In those applications, high strength together with good hole expansion ratio or good bendability are required.

High strength formable steel grades are typically utilized in automated manufacturing lines within the automotive industry, which require homogenous material properties. In particular, the yield strength of the steel must be uniform essentially throughout the full length of the steel strip utilized because variations in yield strength cause changes in the spring back effect, which results in dimensional failures of steel components, which is unacceptable.

Micro-alloying elements, namely small amounts of titanium, niobium and/or vanadium (i.e. less than 0.15 mass-% of each and less than 0.25 mass-% of these elements in total), are used in high strength formable steels. Despite the micro-level of alloying content, these alloying elements are commonly utilized since they provide major improvements in the mechanical properties of such steel products. Due to the low alloying levels, the weldability of these micro-alloyed steels is excellent. Micro-alloying elements facilitate grain refinement during hot-rolling, which results in hot-rolled steel products having a smaller grain size. The strength of hot-rolled steel strips is also increased due to the precipitation of such micro-alloying elements during coiling at temperatures higher than 400° C., such as coiling at a temperature in the range 550 to 650° C., and also during subsequent cooling on a run-out table. At such coiling temperatures, the micro-alloying elements form precipitates, with carbon and/or nitrogen for example, which results in a strength increase because the movement of dislocations within the steel is hindered. When the coiling is carried out at such high temperatures, the microstructure of the hot-rolled steel strip typically becomes ferritic-pearlitic.

However, when hot-rolled steels strips are strengthened by precipitation hardening, manufactured using typical coiling temperatures, and further processed by annealing in a continuous annealing line (hereinafter referred to as CAL), or by annealing in a hot-dip coating line (hereinafter referred to as HDCL), an undesired effect arises. A coarsening of the precipitates namely takes place due to the temperature at which the further processing of the hot-rolled steel strip is carried out, and the time for which the steel is subjected to that temperature. This means that some of the strength increase gained by precipitation hardening may be lost during the further processing. Furthermore, the coarsened precipitates do not eliminate grain growth during annealing in a CAL or in a HDCL, which may lead to excessive grain growth, which adversely affects the formability of the steel. Additionally, coarsened precipitates can serve as starting points for fractures, which weaken the elongation properties of the steel strip.

Additionally, typical high coiling temperatures result in uneven mechanical properties throughout the length of the steel strip. Steel components made from the head or tail of a steel strip which exhibit different mechanical properties can be removed, but this increases the amount of steel material that is lost during the production process, which is always undesired.

In the case of cold-rolled and continuously annealed steels produced using a typical high coiling temperature, it is difficult to achieve yield strength levels above 500 MPa (such as grades having a yield strength of 600-700 MPa) and tensile strength above 875 MPa with a fully recrystallized microstructure without phase hardening. The cold-rolled grain structure should be completely recrystallized after cold-rolling in a continuous annealing process in order for the steel to exhibit acceptable formability, but, in turn, precipitation strengthening should not be lost.

In order to ensure complete recrystallization of the cold-rolled grain structure, the literature has suggested that recrystallization could be facilitated by raising the coiling temperature and/or increasing the cold-rolling reduction. However, coiling at high temperatures leads to coarsened precipitates and unsatisfied strength requirements of such continuously annealed steel strips, as explained above. Furthermore, increased cold-rolling reductions are problematic for the same reason due to the fact that if cold-rolling reductions are increased, the dislocation density is increased, and this speeds up diffusion. This means that at least a partial coarsening of precipitates will easily take place. This in turn decreases the strength of the steel. In other words, particularly in cold-rolled and continuously annealed high strength formable steel strips, there arises a difficulty in how to simultaneously obtain effective precipitation strengthening and complete recrystallization. Furthermore, cold rolling and annealing increase production time and cost compared to a more simple method of hot rolling and direct quenching to low temperature.

European patent no. EP 2,647,730 solves, or at least alleviates the problems outlined above. EP 2,647,730 discloses a high-strength formable continuously annealed steel strip that provides for simultaneous high strength (i.e. steel having a yield strength, $Rp_{0.2}$ in the range of 340 to 800 MPa), good general formability (elongation, A80>10%) and improved formability by reducing variations in yield strength which cause changes in the spring back effect during forming. The method for manufacturing such a continuously annealed high strength formable steel strip product comprises the steps of:

providing a microalloyed steel slab having the following chemical composition (in mass-%): C 0.04-0.18%, Mn 0.2-3.0%, Si 0-2.0%, Al 0-1.5%, Cr 0-2%, Ni 0-2%, Cu 0-2%, Mo 0-0.5%, B 0-0.005%, Ca 0-0.01% and one or more of the following V: 0.01-0.15%, or Nb: 0.005-

0.10%, or Ti: 0.01-0.15%, the balance being iron and unavoidable impurities, and $Mn_{eq}>0.5$, as calculated by the equation below:

$$Mn_{eq}=Mn(\%)+124B(\%)+3Mo(\%)+1\tfrac{1}{2}Cr(\%)+\tfrac{1}{3}Si(\%)+\tfrac{1}{3}Ni(\%)+\tfrac{1}{2}Cu(\%)$$

hot-rolling the steel slab in order to obtain a hot-rolled steel strip, direct quenching the hot-rolled steel strip to a temperature below 400° C., using an average cooling rate of at least 30° C./s to obtain a quenched steel strip, and continuously annealing the quenched steel strip at an annealing temperature between 400-900° C. to obtain a continuously annealed high strength formable steel strip product.

However, EP 2,647,730 discloses that a continuously annealed high strength formable steel strip product having a tensile strength greater than 800 MPa, is difficult to achieve using the method disclosed therein. Additionally, the microstructure of the disclosed continuously annealed high strength formable steel strip product before and after annealing is mainly bainitic ferritic and ferritic. It is well known that such a microstructure (i.e. mainly bainitic ferrite and ferrite as annealed, or not annealed) is not optimal for achieving good bending properties or wear resistance.

US patent application no. US 2018/265939A1 relates to a hot-rolled high-strength steel strip or sheet with excellent roll-forming characteristics and excellent stretch-flange formability suitable for an automotive chassis part or the like, and more particularly, to a high-strength steel strip or sheet with tensile strength of 780 MPa or higher, or preferably 950 MPa or higher, with an excellent combination of total elongation, stretch-flange formability and fatigue resistance, and to a method of manufacturing the steel strip or sheet, and to the use of the strip or sheet in a part.

Japanese patent application no. JP 2015 160985A aims to provide a high strength hot rolled steel sheet excellent in surface quality and punchability and having a tensile strength of 690 MPa or more. The high strength hot rolled steel sheet has a composition containing, by mass %, C: 0.06 to 0.13%, Si: 0.09% or less, Mn: 0.01 to 1.20%, P: 0.03% or less, S: 0.005% or less, Al: 0.1% or less, N: 0.01% or less, Nb: 0.10 to 0.18%, V: 0.03 to 0.20%, Ti: 0.02% or less (including 0) and balance Fe with inevitable impurities, and a structure having an area percentage of a bainite phase of 80% or more, an area percentage of a ferrite phase of 15% or less, an area percentage of a martensite phase of 5% or less, a deposition amount of cementite of 0.08% or more and an average particle diameter of 2 μm or less, and containing carbide having an average particle diameter of less than 10 nm, finely dispersed in a crystal particle of the bainite phase, whereby the Si concentration amount is limited from a surface to depth of 0.2 μm.

SUMMARY OF THE INVENTION

An object of the invention is to provide a hot-rolled steel strip having a tensile strength greater than 875 MPa.

This object is achieved by a hot-rolled steel strip having a tensile strength greater than 875 MPa and having the following chemical composition in mass-%:

C 0.06-0.12,
Si 0-0.5,
Mn 0.70-2.20,
Nb 0.005-0.100,
Ti 0.01-0.10,
V 0.11-0.40,
whereby the total amount of V+Nb+Ti is 0.20-0.40
Al 0.005-0.150,
B 0-0.0008,
Cr 0-1.0,
whereby the total amount of Mn+Cr is 0.9-2.5,
Mo 0-0.5,
Cu 0-0.5,
Ni 0-1.0,
P 0-0.05,
S 0-0.01,
Zr 0-0.1
Co 0-0.1
W 0-0.1
Ca 0-0.005,
N 0-0.01, balance Fe and unavoidable impurities, and having a microstructure at % thickness that is:

at least 90% martensite and bainite with island-shaped martensite-austenite (MA) constituents, preferably at least 95% and more preferably over 98%, the remainder being:

less than 5% polygonal ferrite and quasi-polygonal ferrite, preferably less than 2%, more preferably less than 1%, less than 5% pearlite, preferably less than 2%, more preferably less than 1%, less than 5% austenite, preferably less than 2%, more preferably less than 1% so that the total area percentage is 100%.

It should be noted that the notation "A–B" used throughout this document is intended to include the lower limit, A, and the upper limit, B, and every value between A and B.

The inventors have found that a high-strength hot-rolled steel strip having good wear characteristics and good elongation (such as a total A5 elongation of at least 8%, preferably at least 10%) is obtainable if a relatively high vanadium content of 0.11-0.40 mass-% is used together with 0.005-0.100 mass-% niobium and 0.01-0.10 mass-% titanium, and the total amount of V+Nb+Ti is 0.20-0.40 mass-%. The hot-rolled steel strip according to the present invention thereby maintains the wear resistance, high impact strength and high bendability of the hot-rolled steel strip disclosed in European patent no. EP 2,647,730 and also has a tensile strength greater than 875 MPa. Furthermore, while the a high-strength hot-rolled steel strip according to the present invention may contain up to 0.01 mass-% nitrogen, nitrogen is not an essential element and does not have to be intentionally added to the steel.

According to an embodiment of the invention, the bainite may include granular bainite, upper and lower bainite and acicular ferrite, for example. According to an embodiment of the invention, the proportion of upper bainite is preferably less than 80%. According to an embodiment of the invention, the bainite content is preferably between 20-90%, and the martensite content is preferably 10-80%. According to an embodiment of the invention, for a strip thickness under 3 mm, the bainite content is preferably 20-50% and the martensite content is preferably 50%-80%. According to an embodiment of the invention, for a strip thickness greater than 5 mm the bainite content is preferably 50-90% and the martensite content is preferably 10-50%, whereby the total area percentage is 100% in all of the embodiments cited herein.

Typically, for low strip thicknesses (when a cooling rate very high i.e. at least 30° C./s), the proportion of martensite increases compared to greater thicknesses. For greater thicknesses, the proportion of bainite also increases and the bainite becomes more and more granular.

The microstructure of the hot-rolled steel strip may be determined by evaluating the fractions of different phases in a micrograph of a cross section of the hot-rolled steel strip obtained using an optical microscope, scanning electron microscope or transmission electron microscope.

The hot-rolled steel strip according to the present invention may be of any desired thickness, such as less than 1 mm, 1 mm or more, 2 mm or less, 3 mm or less, 4 mm or less, 5 mm or less, 6 mm or less, or more than 6 mm. The hot-rolled steel strip according to the present invention is namely particularly, but not exclusively, suitable for applications requiring a thinner gauge steel, i.e. steel having a thickness of 6 mm or less. Due to the high impact strength of this steel, it is also possible to use strips having a thickness over 6 mm, normally up to 12 mm and even up to 16 mm, but down coiling may then be difficult.

Typically, when the thickness of the hot-rolled steel strip is 6 mm or less and the cooling rate is very high (i.e. at least 30° C./s), the amount of martensite in the steel increases. When the thickness of the hot-rolled steel strip is greater than 6 mm and the cooling rate is not very high, the amount of martensite decreases and the amount of bainite increases, and the bainite is more and more of the granular type.

For a hot-rolled steel strip of any thickness, the amount of martensite near the centreline of the hot-rolled steel strip is typically greater than the amount of martensite at ¼ thickness, and the amount of martensite at the near surface of the hot-rolled steel strip is less than the amount of martensite at % thickness. The total amount of quasi-polygonal ferrite, polygonal ferrite and/or pearlite at the surface of the hot-rolled steel strip can be greater than the amounts at ¼ thickness. Additionally, annealing is not needed.

According to an embodiment of the invention the total amount of V+Nb+Ti is 0.22-0.40 or 0.25-0.40 mass-%.

According to an embodiment of the invention the hot-rolled steel strip exhibits at least one of the following mechanical properties: a hardness of 260-350 HBW, preferably 270-325 HBW (whereby the Brinell hardness test is performed using a 2.5 mm diameter carbide ball up to 4.99 mm thickness, whereby the hardness is measured at least 0.3 mm from surface (and for thicknesses of 5-7.99 mm, the carbide ball diameter is 5 mm and the hardness is measured at least 0.5 mm from surface, and with a thickness of 8 mm and over, the carbide ball diameter is 10 mm and the hardness is measured at least 0.8 mm from surface), a tensile strength, Rm of 875-1100 MPa, preferably 900-1150 MPa, a total elongation of at least 8% at least 10%, a Charpy V (−40° C.) impact toughness of 34 J/cm$^2$, preferably 50 J/cm$^2$, a minimum bend radius of ≤2.0× t or ≤1.9×t, or ≤1.8× t, or ≤1.7× t, preferably when the bending axis is parallel to the rolling direction and t is the thickness (mm) of steel sample.

According to an embodiment of the invention the niobium content is 0.01-0.05 mass-% when the thickness of the hot-rolled steel strip is less than or equal to 6 mm, and 0.01-10 mass-% when the thickness of the hot-rolled steel strip is greater than 6 mm.

According to an embodiment of the invention the titanium content is 0 to 0.08 mass-% when the thickness of the hot-rolled steel strip is less than or equal to 6 mm, and 0.03 to 0.10 mass-% when the thickness of the hot-rolled steel strip is greater than 6 mm.

The present invention also concerns a method for producing a hot-rolled steel strip according to any of the embodiments of the present invention having a tensile strength greater than 875 MPa, whereby the method comprises the steps of providing a steel slab having the following chemical composition in mass-%:
C 0.06-0.12,
Si 0-0.5,
Mn 0.70-2.2,
Nb 0.005-0.100,
Ti 0.01-0.10,
V 0.11-0.40,
whereby the total amount of V+Nb+Ti is 0.20-0.40
Al 0.005-0.150,
B 0-0.0008,
Cr 0-1.0,
whereby the total amount of Mn+Cr is 0.9-2.5,
Mo 0-0.5,
Cu 0-0.5,
Ni 0-1.0,
P 0-0.05,
S 0-0.01,
Zr 0-0.1
Co 0-0.1
W 0-0.1
Ca 0-0.005,
N 0-0.01,
balance Fe and unavoidable impurities,
heating the steel slab to a temperature of 900-1350° C.,
hot rolling said steel at a temperature of 750-1300° C., and
direct quenching said steel after a final hot-rolling pass at a cooling rate of at least 30° C./s to a coiling temperature less than 400° C., preferably 150° C., more preferably less than 100° C., normally in the range of 25-75° C., whereby a hot-rolled steel strip having the following microstructure at ¼ thickness is obtained:
at least 90% martensite and bainite with island-shaped martensite-austenite (MA) constituents, preferably at least 95% and more preferably over 98%, the remainder being:
less than 5% polygonal ferrite and quasi-polygonal ferrite, preferably less than 2%, more preferably less than 1%,
less than 5% pearlite, preferably less than 2%, more preferably less than 1%, less than 5% austenite, preferably less than 2%, more preferably less than 1%,
so that the total area percentage is 100%.

The coiling temperature must namely be less than 400° C., and it is normally in the range of 25-75° C. since steel that is directly quenched after a final hot-rolling pass will normally have such a temperature due to residual heat from hot-rolling. A coiling temperature greater than 100° C. may adversely affect the flatness of the hot-rolled steel strip.

The present invention is based on the idea of directly quenching a micro-alloyed hot-rolled steel strip after the last hot-rolling pass of a hot-rolling process (i.e. cooling the hot-rolled steel strip at a cooling rate of at least 30° C./s while the hot-rolled steel strip still retains heat from the hot-rolling process to a coiling temperature in the range of 25-75° C.

It is preferred that the temperature of the hot-rolled steel strip is at least 750° C., or more preferably at least 800° C. at the beginning of the quenching step. This means that the quenching in the quenching step can begin within 15 seconds of the last rolling pass of the hot-rolling step. The temperature of the hot-rolled steel strip decreases continuously after the last rolling pass of the hot-rolling step, i.e. the method according to the invention does not include maintaining the hot-rolled steel strip in a two-phase region (between Ar3 and Ar1) or in single phase region (below Ar1) at constant temperature in order to avoid excessive precipitation at this stage, i.e. during the direct quenching step. This means that the direct quenching step is a so-called single cooling step.

The result of the direct quenching step is a quenched steel strip which has the potential to uniformly increase its yield strength by precipitation (if annealed) due to the micro-alloying elements staying uniformly in solution throughout the length of the steel strip, but annealing is not necessary in the method according to the present invention. As a result of the direct quenching step, the steel strip exhibits very little variation in its mechanical properties throughout its rolling length, RL. Some preliminary precipitation may occur during or before the direct quenching step, but at least part, or preferably most of the micro-alloying elements will stay in solution.

A hot-rolled steel strip manufactured using a method according to the present invention consequently exhibits uniform mechanical properties essentially throughout its whole length, i.e. throughout a length of at least 90%, preferably over 95% of its rolling length (RL). The method according to the present invention significantly reduces scatter in the mechanical properties essentially throughout the whole length of the hot-rolled steel strip, especially the scatter in yield and tensile strength. This means that steel material of a coil consisting of the hot-rolled steel strip according to the present invention can be more effectively and safely utilized in automated manufacturing lines and in forming machines, without dimensional failures caused by changes in spring back effect. In other words, the formability of the hot-rolled steel strip according to the present invention is improved since forming will result in more reliable dimensions of the final formed component. Furthermore, the method according to the present invention results in the manufacture of a hot-rolled steel strip that is extremely formable taking into account its strength level.

The present invention thereby relates to the manufacture of hot-rolled steel strips which utilize substantial phase hardening instead of micro-alloying-based strengthening.

According to an embodiment of the invention the method optionally comprises the step of continuously annealing the quenched steel strip at an annealing temperature of 100-400° C. after the direct quenching step if, for example, a bake hardening effect is needed.

Alternatively, a hot-rolled steel strip may be manufactured by heating steel having the chemical composition recited in claim 1 to a temperature of 900-1350° C., hot rolling the steel at a temperature of 750-1300° C. (using a thermomechanical rolling (TMCP) process for example), performing accelerated cooling at a cooling rate of at least 30° C./s and then coiling using a coiling temperature of 580-660° C. (so-called Accelerated Cooling and Coiling (ACC)), whereby hot-rolled steel strip with a microstructure that is at least 95% ferritic is obtained. According to an embodiment of the invention such a hot-rolled steel strip exhibits at least one of the following mechanical properties: a hardness of 260-350 HBW, preferably 270-325 HBW, a yield strength up to 1050 MPa, a tensile strength of 875-1100 MPa, preferably 900-1050 MPa, a total elongation A5 of at least 8%, a Charpy V (−40° C.) impact toughness of 34 J/cm$^2$, preferably 50 J/cm$^2$, a minimum bend radius of ≤2.0× t when the bending axis is preferably longitudinal (i.e. parallel to the rolling direction).

BRIEF DESCRIPTION OF THE DRAWING

The present invention will hereinafter be further explained by means of non-limiting examples with reference to the appended figures where.

DETAILED DESCRIPTION OF EMBODIMENTS

Figure 1:
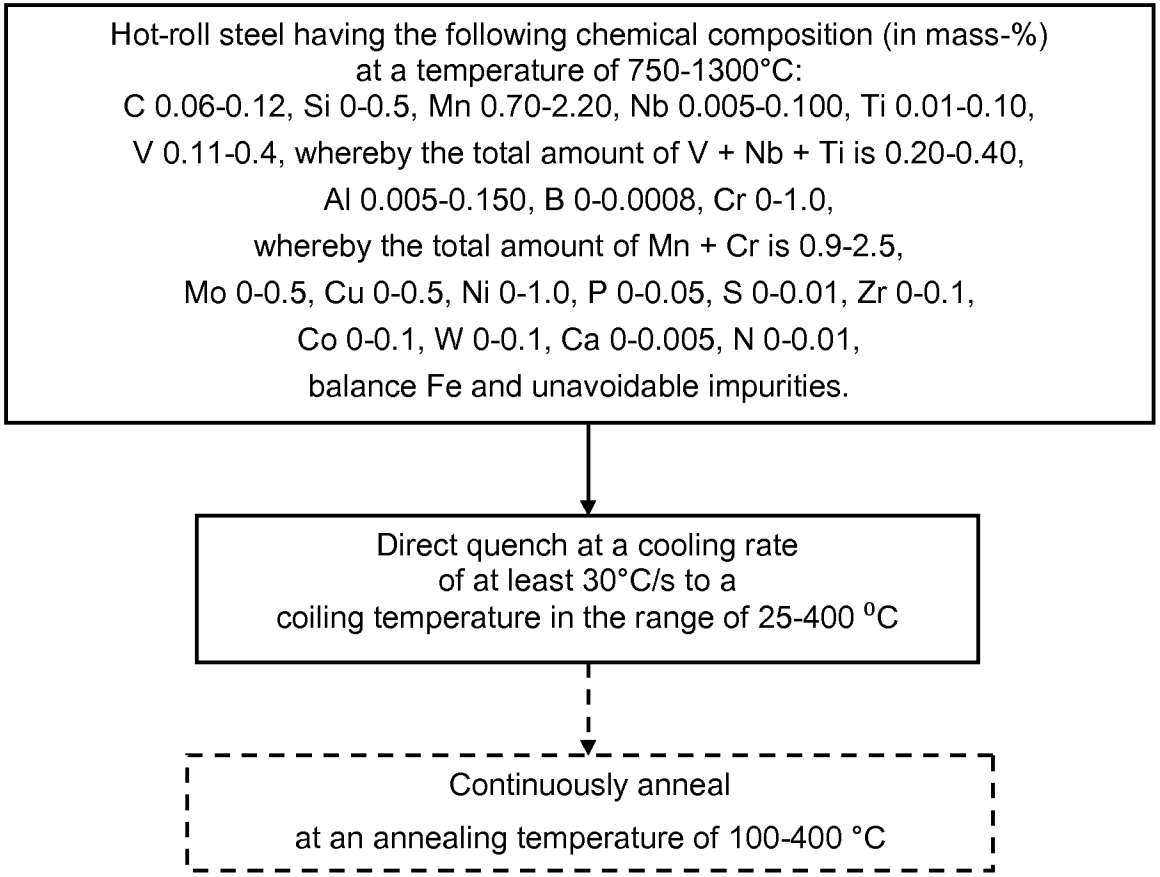
FIG. 1 shows a flow chart of a method according to an embodiment of the invention.

FIG. 1 shows the steps of a method according to an embodiment of the invention in which an optional step has been shown with dashed lines.

The method comprises the step of providing a steel slab having the following chemical composition (in mass-%):

C 0.06-0.12, preferably 0.07-0.10

Si 0-0.5, preferably 0.03-0.5 more preferably 0.03-0.25%

Mn 0.70-2.2, preferably 1.2-2.2, or more preferably 1.2-20

Nb 0.005-0.100, preferably 0.005-0.08, more preferably 0.01-0.08

Ti 0.01-0.10, preferably 0.01-0.08 more preferably 0.02-0.08

V 0.11-0.40, preferably 0.15-0.30 whereby the total amount of V+Nb+Ti is 0.20-0.40 or 0.22-0.40

Al 0.005-0.150, preferably 0.015-0.090

B 0-0.0008, preferably 0-0.0005

Cr 0-1.0, preferably 0-0.3 or 0-0.25 whereby the total amount of Mn+Cr is 0.9-2.5, preferably 1.2-2.0

Mo 0-0.5, preferably 0-0.2 more preferably 0-0.1%

Cu 0-0.5, preferably 0-0.15

Ni 0-1.0, preferably 0-0.15

P 0-0.05, preferably 0-0.02

S 0-0.01, preferably 0-0.005

Zr 0-0.1

Co 0-0.1

W 0-0.1

Ca 0-0.005, preferably 0 0.001-0.004

N 0-0.01, preferably 0.001-0.006 balance Fe and unavoidable impurities.

The steel for hot-rolling may be provided by casting or continuously casting such a micro-alloyed steel slab for example.

According to an embodiment of the present invention the equivalent carbon content, Ceq, of the steel is 0.297-0.837.

For example, the steel may have the following chemical composition (in mass-%): C: 0.09, Si: 0.175, Mn: 1.8, Cr: 0, (Mn+Cr=1.8), Nb: 0.027, V: 0.2, Ti: 0.045 (Nb+V+Ti=0.272), Al: 0.035, B: 0, Mo: 0, Cu: 0, Ni: 0, P: 0, W: 0, Co: 0, S: 0, Zr: 0, Ca: 0.003, Ceq: 0.430.

Carbon is added to increase the strength of the steel by forming solid solution strengthening and precipitating as different kinds of carbides in the matrix. Carbon is also essential to get the desired hard microstructure, which is mainly martensite and bainite. To achieve a desired strength and to obtain the desired precipitation-related benefits, the steel contains carbon 0.06-0.12 mass-%, preferably 0.07-0.10 mass-%. The upper limits are set because if carbon is used excessively, it would weaken the weldability as well as the formability of the steel.

Manganese is included in steel for reasons concerning smelt processing and it is also used to bind sulfur and form MnS. Manganese is also added to increase the strength of the steel. For those reasons, at least 0.70 mass-% is used. An upper limit of 2.20 mass-% is selected in order to avoid excessive strengthening and further to ensure weldability and suitability for optional coating processes. The manganese content is preferably 1.2-2.2 mass-%. Some of the manganese may be replaced by chromium as long as the total amount of Mn+Cr is 0.9-2.5 mass-%, preferably 1.2-2.0 mass-%.

Titanium, niobium and vanadium are added to the steel to form precipitates providing beneficial effects, i.e. carbides, nitrides and carbonitrides and for refining the microstructure of the steel during hot rolling. Vanadium is important in the cooling step to obtain the desired microstructure. The titanium content of the steel is 0.01-0.10 mass-%, preferably 0.005-0.080 mass-%, more preferably 0.02-0.08 mass-%. The niobium content of the steel is 0.005-0.100 mass-%, preferably 0.005-0.08 mass-%, more preferably 0.01-0.08 mass-%. The vanadium content of the steel is 0.11-0.40 mass-%, preferably 0.15-0.30 mass-%. The total amount of V+Nb+Ti is 0.20-0.40 mass-% or 0.22-0.40 mass-%.

Silicon may optionally be added since it, like aluminium, can function as a de-oxidation element, and it can also be also utilized in solid solution strengthening, especially if better surface quality is desired. The upper limit is selected in order to avoid excessive strengthening. The silicon content of the steel may be 0-0.5 mass-%, preferably 0.03-0.5 mass-%, more preferably 0.03-0.25 mass-%.

Aluminium is utilized in an amount of 0.005-0.150 mass-%, preferably 0.015-0.090 mass-%, in order to affect the carbide formation during thermal processing of steel and in de-oxidation.

Chromium can optionally be utilized in an amount of 0-1.0 mass-%, preferably 0-0.3 or 0-0.25 mass-% in order to increase strength. The upper limit is selected in order to avoid excessive strengthening. Furthermore, such a relatively low chromium content improves the weldability of the steel.

Nickel can optionally be utilized in an amount of 0-1.0 mass-%, preferably 0-0.15 mass-%, in order to increase strength. The upper limit is selected in order to avoid excessive strengthening. Furthermore, such a relatively low nickel content improves the weldability of the steel.

Copper can optionally be utilized in an amount of 0-0.5 mass-%, preferably 0-0.15 mass-%, in order to increase strength. The upper limit is selected in order to avoid excessive strengthening. Furthermore, such a relatively low copper content improves the weldability of the steel.

If chromium, nickel and copper are added to the steel, this may impart weather-resistant properties to the steel.

Molybdenum can optionally be utilized in an amount of 0-0.5 mass-%, preferably 0-0.2 mass-%, more preferably 0-0.1 mass-%, in order to increase strength. The upper limit is selected in order to avoid excessive strengthening. Furthermore such a relatively low molybdenum content can improves the weldability of the steel. However molybdenum is not normally needed in the present invention, which decreases the cost of alloying.

Boron can optionally be utilized in an amount of 0-0.0008 mass-%, preferably 0-0.0005 mass-%, 30 in order to increase strength. However, due to the high hardenability factor of boron, it is preferred not to use boron. Boron is not intentionally added to the steel.

Calcium can be included in the steel for reasons concerning smelt processing, in an amount up to 0.005 mass-%, preferably 0 0.001-0.004 mass-%.

In addition to the intentionally and optionally added alloying elements and iron, the steel may comprise small amounts of other elements, such as impurities that originate from smelting. Those impurities are:

- nitrogen, which is an element that can bind micro-alloying elements existing in the steel to nitrides and carbonitrides. This is why a nitrogen content of up to 0.01%, preferably 0.001-0.006 mass-%, may be included in steel. However, a nitrogen content of more than 0.01 mass-% would allow the nitrides to coarsen. Nitrogen is not however intentionally added to the steel.
- phosphorus is usually unavoidably included in steel and should be restricted to 0-0.05 mass-%, preferably 0-0.02 mass-%, since a higher phosphorus content can be harmful for the elongation properties of the steel.
- sulphur is usually unavoidably included in steel and should be restricted to a maximum of 0.01 mass-%, preferably 0-0.005 mass-%. Sulphur decreases the bendability of the steel.
- oxygen may be present in the steel as an unavoidable element, but should be restricted to a maximum of 0.01 mass-%, preferably less than 0.005 mass-%. This is because it may exist as an inclusion that debilitates the formability of the steel.
- the steel may also contain 0-0.1 mass-% zirconium, 0-0.1 mass-% cobalt and/or 0-0.1 mass-% tungsten without adversely affecting the physical properties of the steel.

The method according to the present invention comprises the step of heating the steel slab to a temperature of 900-1350° C. in order to dissolve the micro-alloying elements in the steel slab prior to hot-rolling, and then hot-rolling the steel at a temperature of 750-1300° C., whereby the final rolling temperature (FRT), i.e. a temperature of last hot-rolling pass in the hot-rolling step, that is for example between 850 and 950° C.

The hot-rolling step can be performed at least partly in a strip rolling mill. The hot-rolling step can include hot-rolling at a temperature in the range 750-1350° C., but preferably in the range Ar3 to 1280° C. The hot-rolling step may be a thermomechanical rolling (TMCP) process consisting for example of two stages including rolling in a pre-rolling stage and a subsequent rolling stage in a strip rolling mill having a final rolling temperature (FRT) between 750 and 1000° C. It is however preferred that the final hot-rolling temperature (FRT) in the hot-rolling step is above the Ar3 temperature of the steel. This is because problems related to rolling-texture and strip flatness may otherwise arise. Thermomechanical rolling processes can help to achieve the desired mechanical properties by reducing the grain size of the phase hardened microstructure and increasing further phase substructures.

After a final hot-rolling pass, the steel is direct quenched at a cooling rate of at least 30° C./s to a coiling temperature preferably in the range of 25-75° C. (i.e. residual heat from hot-rolling). A quenched steel strip includes a phase hardened microstructure, such as a microstructure consisting mainly of bainitic-ferrite and martensite, including phase sub-structures that are beneficial for the following process step(s). In addition, the quenching step results in at least part of, or preferably most of the micro-alloying elements being kept in the solution during the cooling from the hot-rolling heat.

The steel strip is coiled after being direct quenched. The temperature of the steel strip can decrease continuously throughout the whole length of the steel strip from the end of direct quenching step to the start of coiling step. The coiling is carried out at low temperature, i.e. preferably at a temperature in the range of 25-75° C.

According to an embodiment of the invention, after coiling, the hot-rolled steel strip may be subjected to one or more further method steps, such as continuous annealing.

Continuous annealing may be carried out at a temperature between 100 and 400° C. The micro-alloying elements begin to precipitate or preliminary precipitates continue to grow when the quenched steel strip is continuously annealed after the direct quenching step if the annealing temperature is higher and the annealing time is long enough, which leads to softening. Such annealing may be performed in a continuous annealing line (CAL) or, in a hot-dip coating line (HDCL). Prior to the annealing step, the hot-rolled steel strip may be pickled.

A hot-dip coating step may include immersing the hot-rolled steel strip into molten metal such as zinc, aluminum or zinc-aluminum, after the annealing step, whereby a hot-dip-coated steel strip having good formability and high strength is obtained.

The continuous annealing temperature is not more than 400° C. Higher temperatures lead to softening. The annealing time in the annealing step can be 10 seconds to 1 week depending on the annealing temperature. Normally, annealing is not needed.

The hot-rolled steel strip has a microstructure at % thickness that is:

at least 90% martensite and bainite with island-shaped martensite-austenite (MA) constituents, preferably at least 95% and more preferably over 98%, the remainder being:

less than 5% polygonal ferrite and quasi-polygonal ferrite, preferably less than 2%, more preferably less than 1%, less than 5% pearlite, preferably less than 2%, more preferably less than 1%, less than 5% austenite, preferably less than 2%, more preferably less than 1%, so that the total area percentage is 100%.

The bainite may include granular bainite, upper and lower bainite and acicular ferrite, for example. According to an embodiment of the invention, the proportion of upper bainite is preferably less than 80%. According to an embodiment of the invention, the bainite content is preferably between 20-90%, and the martensite content preferably 10-80%. According to an embodiment of the invention, for a strip thickness under 3 mm, the bainite content is preferably 20-50% and the martensite content preferably 50%-80%. According to an embodiment of the invention, for a strip thickness greater than 5 mm the bainite content is preferably 50-90% and the martensite content is preferably 10-50%, whereby the total area percentage is 100% in all of the embodiments cited herein. The microstructure can be determined using a scanning electron microscope for example.

According to an embodiment of the invention the hot-rolled steel strip manufactured using a method according to the present invention will also exhibit at least one of the following mechanical properties: a hardness of 260-350 HBW, preferably 270-325 HBW (whereby the Brinell hardness test is performed using a 2.5 mm diameter carbide ball up to 4.99 mm thickness, whereby the hardness is measured at least 0.3 mm from surface (and for thicknesses of 5-7.99 mm, the carbide ball diameter is 5 mm and the hardness is measured at least 0.5 mm from surface, and with a thickness of 8 mm and over, the carbide ball diameter is 10 mm and the hardness is measured at least 0.8 mm from surface, a tensile strength, Rm of 875-1100 MPa, preferably 900-1150 MPa, a total elongation of at least 8% or at least 10%, a Charpy V (−40° C.) impact toughness of 34 J/cm$^2$ preferably 50 J/cm$^2$, a minimum bend radius of ≤2.0× t or ≤1.9× t, or ≤1.8× t, or ≤1.7×t, preferably when the bending axis is parallel to the rolling direction and t is thickness (mm) of the steel sample.

Table 1 shows the steel compositions that were studied in this work, whereby the balance is iron and unavoidable impurities. Steel compositions A1 and A2 are having a chemical composition as recited in the accompanying independent claims and are embodiments of the present invention ("INV"). Steel compositions B, C1, C2, D1, D2 and E1 comprise at least one element in an amount which lies outside the range given in the accompanying independent claims and are not embodiments of the invention, but comparative examples ("REF").

TABLE 1

| | | C | Si | Mn | P | S | Al | Nb | V | Cu | Cr | Ni | N | Mo | Ti | Ca | B |
|---|---|---|---|---|---|---|---|---|---|---|---|---|---|---|---|---|---|
| INV | A1 | 0.087 | 0.20 | 1.81 | 0.012 | 0.0017 | 0.033 | 0.031 | 0.200 | 0.02 | 0.06 | 0.04 | 0.0045 | 0.01 | 0.044 | 0.0026 | 0.0003 |
| | A2 | 0.092 | 0.18 | 1.81 | 0.010 | 0.0014 | 0.031 | 0.032 | 0.195 | 0.02 | 0.05 | 0.04 | 0.0045 | 0.01 | 0.045 | 0.0026 | 0.0004 |
| REF | B | 0.059 | 0.16 | 1.30 | 0.009 | 0.0008 | 0.032 | 0.040 | 0.202 | 0.01 | 0.41 | 0.04 | 0.0060 | 0.15 | 0.002 | 0.0027 | 0.0003 |
| | C1 | 0.070 | 0.05 | 1.37 | 0.009 | 0.0006 | 0.034 | 0.040 | 0.010 | 0.02 | 0.69 | 0.04 | 0.0049 | 0.01 | 0.016 | 0.0024 | 0.0014 |
| | C2 | 0.070 | 0.04 | 1.37 | 0.009 | 0.0003 | 0.043 | 0.042 | 0.008 | 0.02 | 0.70 | 0.05 | 0.0043 | 0.01 | 0.017 | 0.0023 | 0.0013 |
| | D1 | 0.063 | 0.39 | 1.19 | 0.008 | 0.0038 | 0.032 | 0.083 | 0.012 | 0.38 | 0.51 | 0.25 | 0.0054 | 0.01 | 0.105 | 0.0023 | 0.0003 |
| | D2 | 0.056 | 0.40 | 1.19 | 0.008 | 0.0026 | 0.031 | 0.082 | 0.012 | 0.38 | 0.50 | 0.25 | 0.0049 | 0.01 | 0.106 | 0.0022 | 0.0002 |
| | E1 | 0.085 | 0.18 | 1.04 | 0.009 | 0.0045 | 0.026 | 0.003 | 0.045 | 0.03 | 1.33 | 0.06 | 0.0063 | 0.14 | 0.027 | 0.0030 | 0.0019 |

Table 2 shows the process parameters that were used to manufacture the hot-rolled steel strips that were studied in this work

TABLE 2

| | thickness t (mm) | furnace temp. (° C.) | $t_{bar}$ mm) | Rolling temp. (° C.) | FRT (° C.) | Coiling temp. (° C.) | Inventive sample (I)/ Reference sample (R) |
|---|---|---|---|---|---|---|---|
| A1 | 6.0 | 1280 | 29.,5 | 1136 | 882 | 50 | I |
| A1 | 6.0 | 1280 | 29.4 | 1074 | 829 | 50 | I |

TABLE 2-continued

| | thickness t (mm) | furnace temp. (° C.) | $t_{bar}$ mm) | Rolling temp. (° C.) | FRT (° C.) | Coiling temp. (° C.) | Inventive sample (I)/ Reference sample (R) |
|---|---|---|---|---|---|---|---|
| A1 | 3.0 | 1280 | 28.4 | 1129 | 894 | 50 | I |
| A1 | 2.5 | 1280 | 27.4 | 1135 | 894 | 50 | I |
| A1 | 2.2 | 1280 | 27.4 | 1127 | 890 | 50 | I |
| A1 | 3.0 | 1280 | 28.4 | 1131 | 881 | 628 | R |
| A2 | 6.0 | 1280 | 30.5 | 1148 | 917 | 50 | I |
| B | 3.0 | 1260 | 28.4 | 1139 | 859 | 50 | R |
| B | 3.0 | 1260 | 27.4 | 1140 | 922 | 569 | R |
| C1 | 6.0 | 1280 | 30.4 | 1056 | 870 | 50 | R |
| C1 | 6.0 | 1280 | 30.4 | 1079 | 894 | 50 | R |
| C2 | 3.0 | 1280 | 28.5 | 1166 | 893 | 50 | R |
| D1 | 6.0 | 1276 | 30.6 | 1130 | 895 | 50 | R |
| D2 | 4.0 | 1271 | 30.6 | 1140 | 900 | 50 | R |
| E1 | 6.0 | 1279 | 30.5 | 1139 | 925 | 50 | R |

Steel slabs of the steel compositions A1, A2 B, C1, C2, D1, D2 and E1 having a thickness $t_{bar}$ were namely heated in a furnace to the furnace temperature indicated in Table 2 and then subjected to hot-rolling to a final thickness, t, at the rolling temperature and final rolling temperature (FRT) shown in Table 2. After the final hot-rolling pass, the steel compositions were direct quenched at a cooling rate of at least 30 00/s to a coiling temperature of 5000 (apart from one of the steel compositions A1, (which was consequently not manufactured using a method according to the present invention which requires direct quenching to a coiling temperature in the range of 25-75° C.) and one of the comparative examples with steel composition B).

Table 3 shows the mechanical properties of the steel compositions A1, A2 B, C1, C2, D1, D2 and E1.

TABLE 3

| | thickness t (mm) | Hardness HBW | $Rp_{0.2}$ (MPa) | Rm (Mpa) | Rp/Rm ratio | A % | A80% | Charpy V (−40° C.) (J) | ($J/cm^2$) | Bendability R/t (L/T) | Hole Expansion (ISO) | Inventive sample (I)/ Reference sample (R) |
|---|---|---|---|---|---|---|---|---|---|---|---|---|
| A1 | 6.0 | 279 | 766 | 934 | 0.82 | 13.7 | — | 40 | 83 | 1.33/0.33 | — | I |
| A1 | 6.0 | 271 | 746 | 923 | 0.81 | 15.1 | — | 53 | 110 | 1.33/0.33 | — | I |
| A1 | 3.0 | 298 | 793 | 962 | 0.82 | 14.2 | — | — | — | 1.67/0.33 | 34 | I |
| A1 | 2.5 | 311 | 816 | 998 | 0.82 | 14.7 | — | — | — | 1.2/0.4 | — | I |
| A1 | 2.2 | 302 | 854 | 994 | 0.86 | 13.9 | — | — | — | 0.91/0.45 | — | I |
| A1 | 3.0 | 277 | 702 | 816 | 0.86 | 19.5 | — | 14 | 58 | 0.33/0.33 | 40 | R |
| A2 | 6.0 | 300 | 837 | 998 | 0.84 | 10.2 | — | 40 | 100 | 1.25/0.75 | — | I |
| B | 3.0 | — | 631 | 809 | 0.78 | — | 14.6 | — | — | — | 34 | R |
| B | 3.0 | — | 641 | 777 | 0.82 | — | 17.6 | — | — | — | 63 | R |
| C1 | 6.0 | 328 | 886 | 1002 | 0.88 | 10.9 | — | 60 | 150 | 2.7/1.7 | — | R |
| C1 | 6.0 | 327 | 942 | 1030 | 0.91 | 10.1 | — | 64 | 160 | 4.2/2.3 | — | R |
| C2 | 3.0 | 330 | 987 | 1087 | 0.91 | 11.6 | — | — | — | 4.3/3.7 | — | R |
| D1 | 6.0 | — | 735 | 865 | 0.85 | 15.1 | — | 60 | 125 | 1.0/0.2 | — | R |
| D2 | 4.0 | — | 733 | 869 | 0.84 | 17.2 | — | 42 | 131 | 0.5/0.25 | — | R |
| E1 | 6.0 | — | 1025 | 1124 | 0.91 | 11.9 | — | 42 | 88 | — | — | R |

Conventional steel usually has a fully martensitic microstructure, a hardness of 400 HBW or more and a minimum bend radius, R/t of 2.5-5.0.

Neither conventional steel nor the comparative examples exhibit such good bendability combined to high tensile strength as the hot-rolled steel strip according to the present invention. Furthermore, the hot-rolled steel strip according to the present invention exhibits good bendability both in its longitudinal direction, L, (i.e. rolling direction, RT) and its transverse direction, T.

Additionally, the hot-rolled steel strip according to the present invention has a lower hardness than conventional steel and the comparative examples and is thereby more suitable for applications in which good bendability as well as good wear resistance and also high tensile strength are required together with high impact strength.

Figure 2:
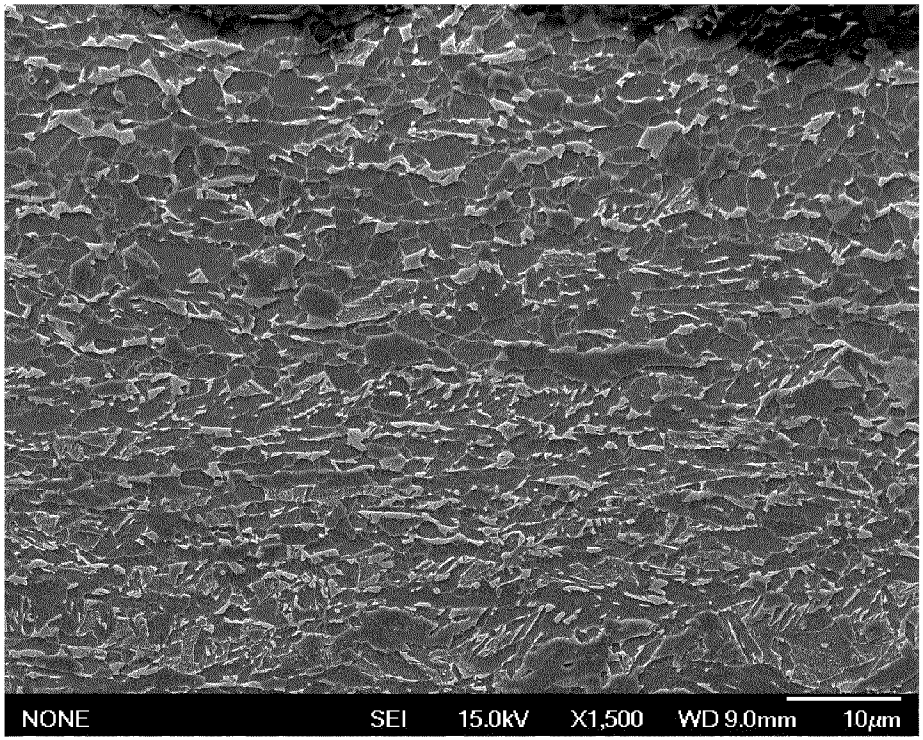
FIG. 2 shows the microstructure at the surface of a 6 mm thick hot-rolled steel strip according to an embodiment of the invention.
Figure 3:
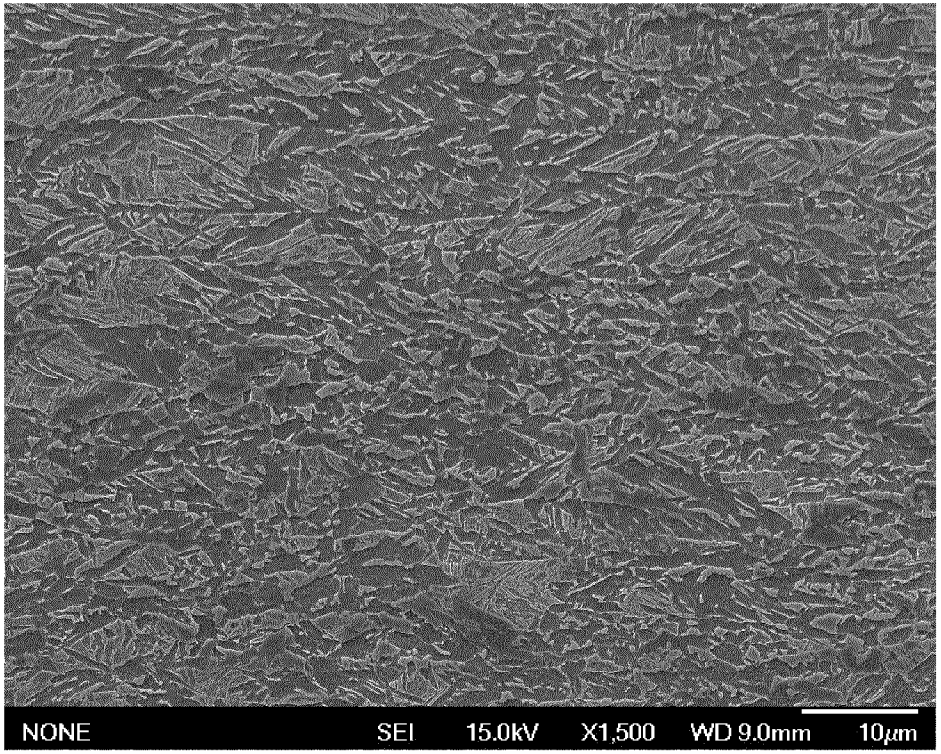
FIG. 3 shows the microstructure 1.5 mm below the surface (i.e. at ¼ thickness) of a 6 mm thick hot-rolled steel strip according to an embodiment of the invention.
Figure 5:
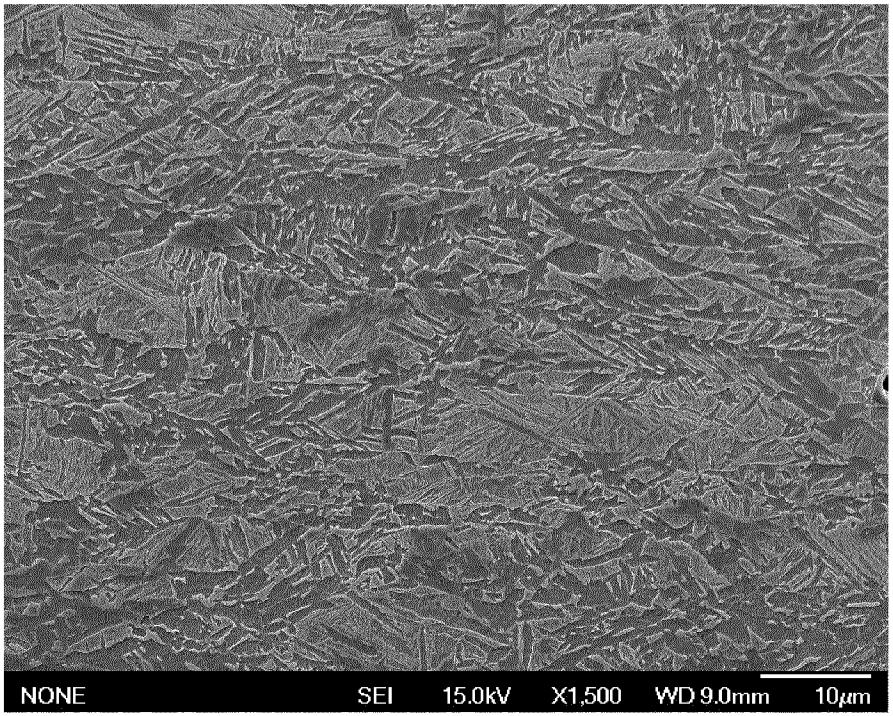
FIG. 5 shows the microstructure 3.0 mm below the surface (i.e. at ¼ thickness) of a 6 mm thick hot-rolled steel strip according to an embodiment of the invention.

FIGS. 2, 3 and 5 show the microstructure of a 6 mm thick hot-rolled steel strip according to an embodiment of the invention at the surface, 1.5 mm below the surface (i.e. at % thickness) and 3.0 mm below the surface (i.e. at $\%_2$ thickness) respectively.

Figure 4:
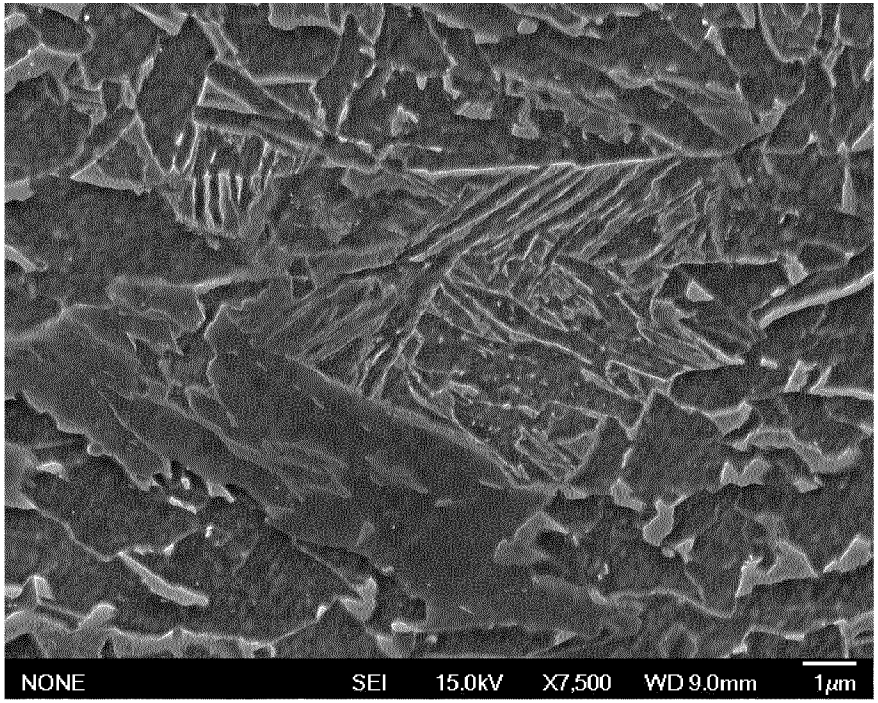
FIG. 4 shows a feature of the microstructure of FIG. 3 at a greater magnification.

FIG. 4 shows a feature of the microstructure 1.5 mm below the surface (i.e. at % thickness) at a greater magnification than in FIG. 3.

The microstructure at % thickness (shown in FIGS. 3 and 4) is at least 90% martensite and bainite with island-shaped martensite-austenite (MA) constituents. The remaining 10% of the microstructure may comprise polygonal ferrite and/or quasi-polygonal ferrite and/or pearlite and/or austenite.

Tests

Weldability testing was performed on 6 mm thick hot-rolled strips of the steel having the chemical composition Al in Table 1.

Weldability testing was carried out by welding four butt joints using test pieces having the dimensions of 6×200×1050 mm. The test pieces were cut from the middle of the coil along the principal rolling direction so that 1050 mm-long butt welds were transversal to rolling direction.

The joints were welded using a metal active gas (MAG) welding process and two different welding consumables were tested:

a) unalloyed solid wire Lincoln Supramig (YS 420 MPa) which does not match (i.e. does not equal) the strength of the hot-rolled steel strip according to the present invention, but has a lower strength, and b) matching solid wire Böhler X70 IG (YS 690 MPa), which matches (i.e. equals) the strength of the hot-rolled steel strip according to the present invention.

The butt joints were welded using single V-groove preparation with a 60° groove angle and without preheating. The calculated $t_{8/5}$ time range during the welding tests was between 7-19 seconds, whereby the time $t_{8/5}$ is the time in which a cooling of the welding layer from 800° C. to 500° C. occurs.

Figure 6:
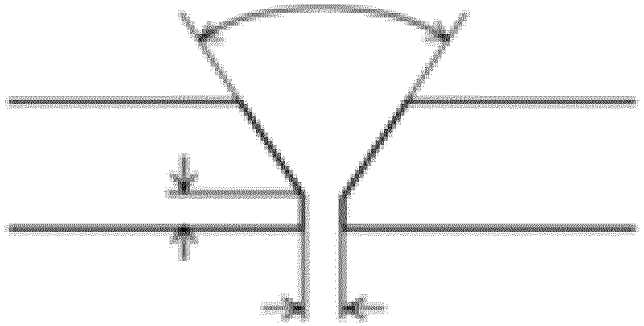
FIG. 6 shows the weld groove geometry that was used in the weldability tests described herein.
Figure 7:
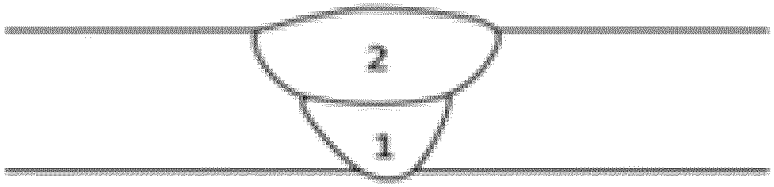
FIG. 7 shows the weld pass arrangement that was used in the weldability tests described herein.

FIG. 6 shows the weld groove geometry that was used in the weldability tests and FIG. 7 shows the weld pass arrangement.

The results obtained from the above-mentioned tests are presented in Tables 4-6 below.

In the tests labelled "Bohler Low", the second weld pass $t_{8/5}$ time was 6.7 s. Such a short cooling time from 800° C. to 500° C. ($t_{8/5}$) means that a low heat input was used in the welding.

In the tests labelled "Bohler High", the second weld pass $t_{8/5}$ time was 15.0 s. Such a long cooling time from 800° C. to 500° C. ($t_{8/5}$) means that a high heat input was used in the welding.

In the tests labelled "SupraMIG Low", the second weld pass $t_{8/5}$ time was 6.7 s.

The mechanical testing of welded joints included the following tests two transverse tensile tests Charpy-V testing at −40° C. with three 5×10 mm specimen at the following locations: weld centerline, fusion line (FL)+1 mm, fusion line (FL)+3 mm and fusion line (FL)+5 mm.

Both the yield strength and the tensile strength of the welds fulfilled the requirements set for S700 MC base material stated in standard EN 10149-2. When using a matching wire Bohler X70 IG and a higher heat input ($t_{8/5}$=15 s), it was found that the strength requirements set for S700 MC base material in EN standard 10149-2 were also fulfilled.

Typically, for high strength structural steels welding tests should be conducted in accordance with welding procedure test standard ISO 15614:2017. This standard requires that Charpy-V impact energy tests are conducted at two locations; from the middle of the weld metal and 1 mm from the weld's fusion line to base material. The impact toughness measured at the required locations fulfilled 34 J/cm$^2$ at −40° C., or in other words 27 J with a full size test specimen when the $t_{8/5}$ time was up to 15 seconds. However with higher heat input and when the $t_{8/5}$ cooling time was 19 seconds, the impact toughness was less than 34 J/cm$^2$ at −40° C. The achievement of 27 J with a full size test specimen is a minimum requirement for S700 MC.

Usually, wear-resistant steels, such as the hot-rolled steel strip according to the present invention, are welded using lower strength welding consumables, i.e. undermatching welding consumables. Structural steels, are, on the contrary, welded using matching strength welding consumables.

It is therefore surprising that the hot-rolled steel strip according to the present invention may be welded using matching strength welding consumables and achieve mechanical properties that fulfil standard requirements for structural steels.

The inventors have namely found that the hot-rolled steel strip according to the present invention, which is a wear-resistant steel, may be welded like a structural steel and achieve mechanical properties fulfilling the requirements set for base steel S700 MC material.

TABLE 4

| Charpy impact test results at T: −40° C. | | | | Böhler Low | Böhler High | SupraMIG Low |
|---|---|---|---|---|---|---|
| Direction | Notch position | Dimension (10 · x mm) | Area mm2 | Impact Energy per (J/cm$^2$) | Impact Energy per cm (J/cm$^2$) | Impact Energy per cm (J/cm$^2$) |
| L | WM | 5 | 40 | 138 | 133 | 104 |
| L | FL | 5 | 40 | 36 | 43 | 78 |
| L | FL + 1 mm | 5 | 40 | 70 | 62 | 74 |
| L | FL + 3 mm | 5 | 40 | 107 | 84 | 122 |
| L | FL + 5 mm | 5 | 40 | 116 | 99 | 118 |

TABLE 5

| | Böhler low | | Böhler high | | SupraMIG low | |
|---|---|---|---|---|---|---|
| Welding pass no.–> | 1 | 2 | 1 | 2 | 1 | 2 |
| Welding method: | MAG 135 | MAG 135 | MAG 135 | MAG 135 | MAG 135 | MAG 135 |
| Welding direction: | T | T | T | T | T | T |
| Weld position: | PA | PA | PA | PA | PA | PA |
| Current (A) | 249.0 | 259.0 | 250.0 | 260.0 | 249.0 | 259.0 |
| Voltage (V) | 25.1 | 27.5 | 24.9 | 28.0 | 24.5 | 27.0 |
| Travel speed (cm/min) | 63.0 | 71.5 | 62.4 | 48.3 | 61.7 | 69.7 |
| Heat input (kJ/mm) | 0.5 | 0.5 | 0.5 | 0.7 | 0.5 | 0.5 |
| Cooling time, t8/5 (s) | 6.7 | 6.7 | 6.7 | 15.0 | 6.4 | 6.7 |
| Preheat temp (° C.) | 25.0 | 25.0 | 25.0 | 25.0 | 25.0 | 25.0 |
| Flux type: | 0.0 | 0.0 | 0.0 | 0.0 | 0.0 | 0.0 |
| Electrode diameter (mm) | 1.0 | 1.0 | 1.0 | 1.0 | 1.0 | 1.0 |
| Electrode: | Böhler X70IG | Böhler X70IG | Böhler X70IG | Böhler X70IG | SupraMIG | SupraMIG |
| Shielding gas | Mison 8 | Mison 8 | Mison 8 | Mison 8 | Mison 8 | Mison 8 |

TABLE 6

| Tensile test results | | | | | | | | | |
|---|---|---|---|---|---|---|---|---|---|
| Böhler low | | | | | Böhler high | | | | |
| Number | Direct. | Rp0.2 (N/mm2) | Rm (N/mm2) | A80 (%) | Number | Direct. | Rp0.2 (N/mm2) | Rm (N/mm2) | A80 (%) |
| 1 | L | 775 | 881 | 8.5 | 1 | L | 723 | 837 | 7.0 |
| 2 | L | 774 | 883 | 6.5 | 2 | L | 717 | 830 | 7.2 |
| Avg. | | 774.5 | 832 | 7.5 | Avg. | | 720 | 834 | 7.1 |

TABLE 6-continued

| Tensile test results | | | | |
|---|---|---|---|---|
| SupraMIG low | | | | |
| Number | Direct. | Rp0.2 (N/mm2) | Rm (N/mm2) | A80 (%) |
| 1 | L | 710 | 810 | 4.9 |
| 2 | L | 706 | 810 | 4.9 |
| Avg. | | 708 | 810 | 4.9 |

Further modifications of the invention within the scope of the claims would be apparent to a skilled person.

The invention claimed is:

1. A hot-rolled steel strip having a tensile strength greater than 875 MPa and containing in mass-%:
C 0.06-0.12,
Si 0-0.5,
Mn 0.70-2.20,
Nb 0.005-0.100,
Ti 0.01-0.10,
V 0.11-0.40,
whereby the total amount of V+Nb+Ti is 0.20-0.40,
Al 0.005-0.150,
B 0-0.0008,
Cr 0-1.0,
whereby the total amount of Mn+Cr is 0.9-2.5,
Mo 0-0.5,
Cu 0-0.5,
Ni 0-1.0,
P 0-0.05,
S 0-0.01,
Zr 0-0.1,
Co 0-0.1,
W 0-0.1,
Ca 0-0.005,
N 0-0.01,
balance Fe and unavoidable impurities, and having a microstructure at ¼ thickness that is:
an area percentage of at least 90% martensite and bainite with island-shaped martensite-austenite (MA) constituents,
the remainder being:
an area percentage of less than 5% polygonal ferrite and quasi-polygonal ferrite,
an area percentage of less than 5% pearlite,
an area percentage of less than 5% austenite,
so that the total area percentage is 100%.

2. The hot-rolled steel strip according to claim 1, whereby the total amount of V+Nb+Ti is 0.22-0.40.

3. The hot-rolled steel strip according to claim 1, whereby the hot-rolled steel strip exhibits at least one of the following mechanical properties: a hardness of 260-350 HBW, a yield strength up to 1050 MPa, a tensile strength of 875-1100 MPa, a total elongation A5 of at least 8%, a Charpy V (−40° C.) impact toughness of 34 J/cm$^2$, a minimum bend radius of ≤2.0×thickness of steel sample (t) when the bending axis is parallel to the rolling direction.

4. The hot-rolled steel strip according to claim 1, having a thickness of 12 mm or less.

5. The hot-rolled steel strip according to claim 1, whereby the niobium content is 0.01-0.05 mass-% when the thickness of steel sample (t), t≤6 mm and the niobium content is 0.01-0.10 mass-% when the thickness of steel sample (t), t>6 mm.

6. The hot-rolled steel strip according to claim 1, whereby the titanium content is 0.01-0.07 mass-% when the thickness of steel sample (t), t≤6 mm and the titanium content is 0.03-0.10 mass-% when the thickness of steel sample (t), t>6 mm.

7. The hot-rolled steel strip according to claim 1, whereby the carbon content is 0.07-0.10 mass-%.

8. The hot-rolled steel strip according to claim 1, whereby the manganese content is 1.20-2.20 mass-%.

9. The hot-rolled steel strip according to claim 1, whereby the niobium content is 0.005-0.080 mass-%.

10. The hot-rolled steel strip according to claim 1, whereby the vanadium content is 0.15-0.30 mass-%.

11. The hot-rolled steel strip according to claim 1, whereby the aluminium content is 0.015-0.090 mass-%.

12. The hot-rolled steel strip according to claim 1, whereby the total amount of Mn+Cr is 1.2-2.0 mass-%.

13. A method for producing a hot-rolled steel strip having a tensile strength greater than 875 MPa, whereby the method comprises the steps of providing a steel slab containing in mass-%:
C 0.06-0.12,
Si 0-0.5,
Mn 0.70-2.2,
Nb 0.005-0.100,
Ti 0.01-0.10,
V 0.11-0.40,
whereby the total amount of V+Nb+Ti is 0.20-0.40,
Al 0.005-0.150,
B 0-0.0008,
Cr 0-1.0,
whereby the total amount of Mn+Cr is 0.9-2.5,
Mo 0-0.5,
Cu 0-0.5,
Ni 0-1.0,
P 0-0.05,
S 0-0.01,
Zr 0-0.1,
Co 0-0.1,
W 0-0.1,
Ca 0-0.005,
N 0-0.01,
balance Fe and unavoidable impurities,
heating the steel slab to a temperature of 900-1350° C.,
hot rolling said steel at a temperature of 750-1300° C., and
direct quenching said steel after a final hot-rolling pass at a cooling rate of at least 30° C./s to a coiling temperature less than 400° C., whereby a hot-rolled steel strip having the following microstructure at % thickness is obtained:
an area percentage of at least 90% martensite and bainite with island-shaped martensite-austenite (MA) constituents, the remainder being:

an area percentage of less than 5% polygonal ferrite and quasi-polygonal ferrite, an area percentage of less than 5% pearlite, an area percentage of less than 5% austenite, so that the total area percentage is 100%.

14. The method according to claim 13, which further comprises the step of continuously annealing the quenched steel strip at an annealing temperature of 100-400° C. after the direct quenching step.

* * * * *